US010197050B2

(12) United States Patent
Robison et al.

(10) Patent No.: US 10,197,050 B2
(45) **Date of Patent: *Feb. 5, 2019**

(54) RECIPROCATING ROD PUMPING UNIT

(71) Applicant: Weatherford Technology Holdings, LLC, Houston, TX (US)

(72) Inventors: Clark E. Robison, Tomball, TX (US); Benson Thomas, Pearland, TX (US); Michael Gilbert Chavira, Humble, TX (US); Luis Alberto Garcia, Humble, TX (US); Jeffrey Wing Lun Seto, Stafford, TX (US); Michael Charles Ramsey, Round Rock, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 73 days.

This patent is subject to a terminal disclaimer.

(21) Appl. No.: 15/004,260

(22) Filed: Jan. 22, 2016

(65) Prior Publication Data

US 2017/0204846 A1 Jul. 20, 2017

Related U.S. Application Data

(60) Provisional application No. 62/278,930, filed on Jan. 14, 2016.

(51) Int. Cl.
*E21B 47/02* (2006.01)
*F04B 49/02* (2006.01)
(Continued)

(52) U.S. Cl.
CPC ..... *F04B 49/02* (2013.01); *E21B 43/126* (2013.01); *F04B 17/03* (2013.01); *F04B 19/22* (2013.01);
(Continued)

(58) Field of Classification Search
CPC ..... E21B 43/126
(Continued)

(56) References Cited

U.S. PATENT DOCUMENTS 2,683,379 A 7/1954 Strandgren
3,710,927 A * 1/1973 Alsted ..... B65G 39/16 198/807
(Continued)

FOREIGN PATENT DOCUMENTS

WO 2014/182272 A1 11/2014

OTHER PUBLICATIONS

Canadian Office Action in related application CA 2,954,177 dated Oct. 24, 2017.
(Continued)

*Primary Examiner* — Taras P Bemko
(74) *Attorney, Agent, or Firm* — Patterson + Sheridan, LLP

(57) ABSTRACT

A reciprocating rod pumping unit includes a tower; a counterweight assembly movable along the tower; and a drum connected to an upper end of the tower and rotatable relative thereto. The unit also includes a belt having a first end connected to the counterweight assembly, extending over the drum, and having a second end connectable to a rod string. The unit further includes a prime mover for reciprocating the counterweight assembly along the tower; a sensor for detecting a condition of the pumping unit; a brake system for halting movement of the counterweight assembly; and a controller in communication with the at least one of the sensors and operable to activate the brake system in response to detection of the faulty condition of the pumping unit.

26 Claims, 9 Drawing Sheets

(51) Int. Cl.

| | |
|---|---|
| ***E21B 43/12*** | (2006.01) |
| ***F04B 17/03*** | (2006.01) |
| ***F04B 19/22*** | (2006.01) |
| ***F04B 47/02*** | (2006.01) |
| ***F04B 47/14*** | (2006.01) |
| ***F04B 49/10*** | (2006.01) |
| ***F04B 51/00*** | (2006.01) |
| ***F04B 53/14*** | (2006.01) |
| ***F04B 53/18*** | (2006.01) |

(52) U.S. Cl.
CPC ..... *F04B 47/02* (2013.01); *F04B 47/14* (2013.01); *F04B 49/10* (2013.01); *F04B 51/00* (2013.01); *F04B 53/144* (2013.01); *F04B 53/18* (2013.01)

(58) Field of Classification Search
USPC ..... 166/75.11
See application file for complete search history.

(56) References Cited

U.S. PATENT DOCUMENTS 3,917,092 A 11/1975 McGinnis
4,519,262 A * 5/1985 Le ..... F04B 47/02 187/363
4,647,050 A 3/1987 Johnson
4,761,120 A * 8/1988 Mayer ..... E21B 43/127 417/403
4,916,959 A 4/1990 Lively
4,932,253 A 6/1990 McCoy
5,020,640 A 6/1991 Nederbragt
5,196,770 A 3/1993 Champs et al.
5,281,100 A * 1/1994 Diederich ..... E21B 43/127 417/18
5,375,657 A * 12/1994 Shi ..... E21B 43/126 166/105
5,385,514 A 1/1995 Dawe
5,404,767 A 4/1995 Sutherland
5,440,183 A 8/1995 Denne
5,540,095 A 7/1996 Sherman et al.
5,611,500 A * 3/1997 Smith ..... B65H 18/26 242/534
6,011,508 A 1/2000 Perreault et al.
6,101,952 A 8/2000 Thornton et al.
6,499,701 B1 12/2002 Thornton et al.
6,508,132 B1 1/2003 Lohr et al.
6,578,495 B1 6/2003 Yitts et al.
6,606,569 B1 8/2003 Potts
6,770,004 B1 8/2004 Lofgren et al.
6,851,476 B2 2/2005 Gray et al.
6,983,701 B2 1/2006 Thornton et al.
7,178,600 B2 2/2007 Luke et al.
7,290,476 B1 11/2007 Glasson
7,373,971 B2 5/2008 Montgomery
7,530,799 B2 5/2009 Smith
7,579,941 B2 8/2009 Cleveland et al.
7,857,043 B2 12/2010 Ali-zada
8,036,829 B2 10/2011 Gibbs et al.
8,256,579 B2 9/2012 Jia
8,328,527 B2 12/2012 Ehimeakhe
8,616,134 B2 12/2013 King et al.
8,624,699 B2 1/2014 Hunter et al.
8,849,954 B2 9/2014 Kim
8,851,860 B1 10/2014 Mail
8,858,187 B2 10/2014 Lane
2001/0021347 A1* 9/2001 Mills ..... E21B 47/0006 417/18
2006/0024177 A1* 2/2006 Robison ..... F04B 47/04 417/390
2008/0018603 A1 1/2008 Baraz et al.
2012/0020808 A1 1/2012 Lawson et al.
2012/0230841 A1* 9/2012 Gregory ..... F04B 47/02 417/44.1
2013/0186638 A1 7/2013 Filippov et al.
2014/0069720 A1 3/2014 Gray
2014/0312716 A1 10/2014 Hunter et al.
2015/0136407 A1* 5/2015 Bailey ..... E21B 21/08 166/335
2015/0292307 A1* 10/2015 Best ..... E21B 43/129 166/369
2015/0337648 A1 11/2015 Zippel et al.

OTHER PUBLICATIONS

Weatherford; Rotaflex Long-Stroke Pumping Units; Artificial Lift Systems; date unknown; 17 total pages.
Analog Devices; Data Sheet; Precision ±1.7 g, ±5 g, ±18 g Single-/Dual-Axis iMEMS Accelerometer; 2004-2014; 16 total pages.
Dr. Richard Thornton; Elevator World; Linear Synchronous Motors for Elevators dated Sep. 2006; 2 total pages.
Weatherford; Production Optimization; Stainless Steel Polished-Rod Load Cell dated 2008; 2 total pages.
Wieler, et al.; Elevator World; Linear Synchronous Motor Elevators Become a Reality; dated May 2012; 4 total pages.
MagneMotion; LSM Elevators; White Paper dated 2013; 2 total pages.
Weatherford; Rotaflex Long-Stroke Pumping Units; Proven Technology for Deep, Challenging, and High-Volume Wells; dated 2014; 24 total pages.
Canadian Office Action in related matter CA 2954177 dated Oct. 24, 2018.

* cited by examiner

RECIPROCATING ROD PUMPING UNIT

BACKGROUND OF THE DISCLOSURE

Field of the Disclosure

The present disclosure generally relates to a reciprocating rod pumping unit.

Description of the Related Art

To obtain hydrocarbon fluids, a wellbore is drilled into the earth to intersect a productive formation. Upon reaching the productive formation, an artificial lift system is often necessary to carry production fluid (e.g., hydrocarbon fluid) from the productive formation to a wellhead located at a surface of the earth. A reciprocating rod pumping unit is a common type of artificial lift system.

The reciprocating rod pumping unit generally includes a surface drive mechanism, a sucker rod string, and a downhole pump. Fluid is brought to the surface of the wellbore by reciprocating pumping action of the drive mechanism attached to the rod string. Reciprocating pumping action moves a traveling valve on the pump, loading it on the down-stroke of the rod string and lifting fluid to the surface on the up-stroke of the rod string. A standing valve is typically located at the bottom of a barrel of the pump which prevents fluid from flowing back into the well formation after the pump barrel is filled and during the down-stroke of the rod string. The rod string provides the mechanical link of the drive mechanism at the surface to the pump downhole.

One such surface drive mechanism is known as a long-stroke pumping unit. The long-stroke pumping unit includes a counterweight which travels along a tower during operation thereof. Should the sucker rod string fail, there is a potential that the counterweight assembly will free fall and damage various parts of the pumping unit as it crashes under the force of gravity. The sudden acceleration of the counterweight assembly may not be controllable using the existing long-stroke pumping unit.

SUMMARY OF THE DISCLOSURE

The present disclosure generally relates to a braking system for a reciprocating rod pumping unit. In one embodiment, a reciprocating rod pumping unit includes: a tower; a counterweight assembly movable along the tower; a drum connected to an upper end of the tower and rotatable relative thereto; a belt having a first end connected to the counterweight assembly, extending over the drum, and having a second end connectable to a rod string; a prime mover for reciprocating the counterweight assembly along the tower; a sensor for detecting sudden acceleration of the counterweight assembly due to failure of the rod string; at least one of: a braking system for halting free-fall of the counterweight assembly; and an arrestor system for absorbing kinetic energy of the falling counterweight assembly; and a controller in communication with the sensor and operable to activate the braking or arrestor system in response to detection of the sudden acceleration.

In one embodiment, a reciprocating rod pumping unit includes a tower; a counterweight assembly movable along the tower; a drum connected to an upper end of the tower and rotatable relative thereto; a belt having a first end connected to the counterweight assembly, extending over the drum, and having a second end connectable to a rod string; a prime mover for reciprocating the counterweight assembly along the tower; a sensor for detecting a condition of the pumping unit; a brake system for halting free-fall of the counterweight assembly; and a controller in communication with the sensor and operable to activate the brake system in response to detection of the faulty condition of the pumping unit. In one example, the sensor is selected from the group consisting of a speed sensor for detecting a speed of the belt; a cycle sensor for detecting a cycle of the belt; a load sensor for detecting a change in load on the drum; a belt alignment sensor for detecting an alignment of the belt; a vibration sensor for detecting a vibration of the tower; and combinations thereof.

In another embodiment, a reciprocating rod pumping unit includes a tower; a counterweight assembly movable along the tower; a drum connected to an upper end of the tower and rotatable relative thereto; a belt having a first end connected to the counterweight assembly, extending over the drum, and having a second end connectable to a rod string; a prime mover for reciprocating the counterweight assembly along the tower; a sensor for detecting a condition of the pumping unit; and a controller in communication with the sensor and operable to cause the counterweight assembly to stop in response to the detected condition. In one example, the sensor is selected from the group consisting of a speed sensor for detecting a speed of the belt; a cycle sensor for detecting a cycle of the belt; a load sensor for detecting a change in load on the drum; a belt alignment sensor for detecting an alignment of the belt; a vibration sensor for detecting a vibration of the tower; and combinations thereof.

In another embodiment, a reciprocating rod pumping unit includes a tower; a counterweight assembly movable along the tower; a drum connected to an upper end of the tower and rotatable relative thereto; a belt having a first end connected to the counterweight assembly, extending over the drum, and having a second end connectable to a rod string; a prime mover for reciprocating the counterweight assembly along the tower; a lubrication system for applying lubricant to at least one of a chain, a bearing, and combinations thereof; at least one of a lubrication sensor for detecting an amount of lubricant in the lubrication system, a pressure sensor for detecting a pressure in the lubrication system, and a flow meter for measuring a flow rate of the lubricant; and a controller in communication with the at least one of the lubrication sensor, the pressure sensor, and the flow meter, and operable to cause the counterweight assembly to stop.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 3A is a perspective view of the carriage. FIG. 3B is a cross-sectional view of the carriage. FIG. 3C is a cross-sectional view of the bushing and bushing shaft. FIGS. 3D-3E are different perspective views of the carriage.

DETAILED DESCRIPTION

Figure 1A:
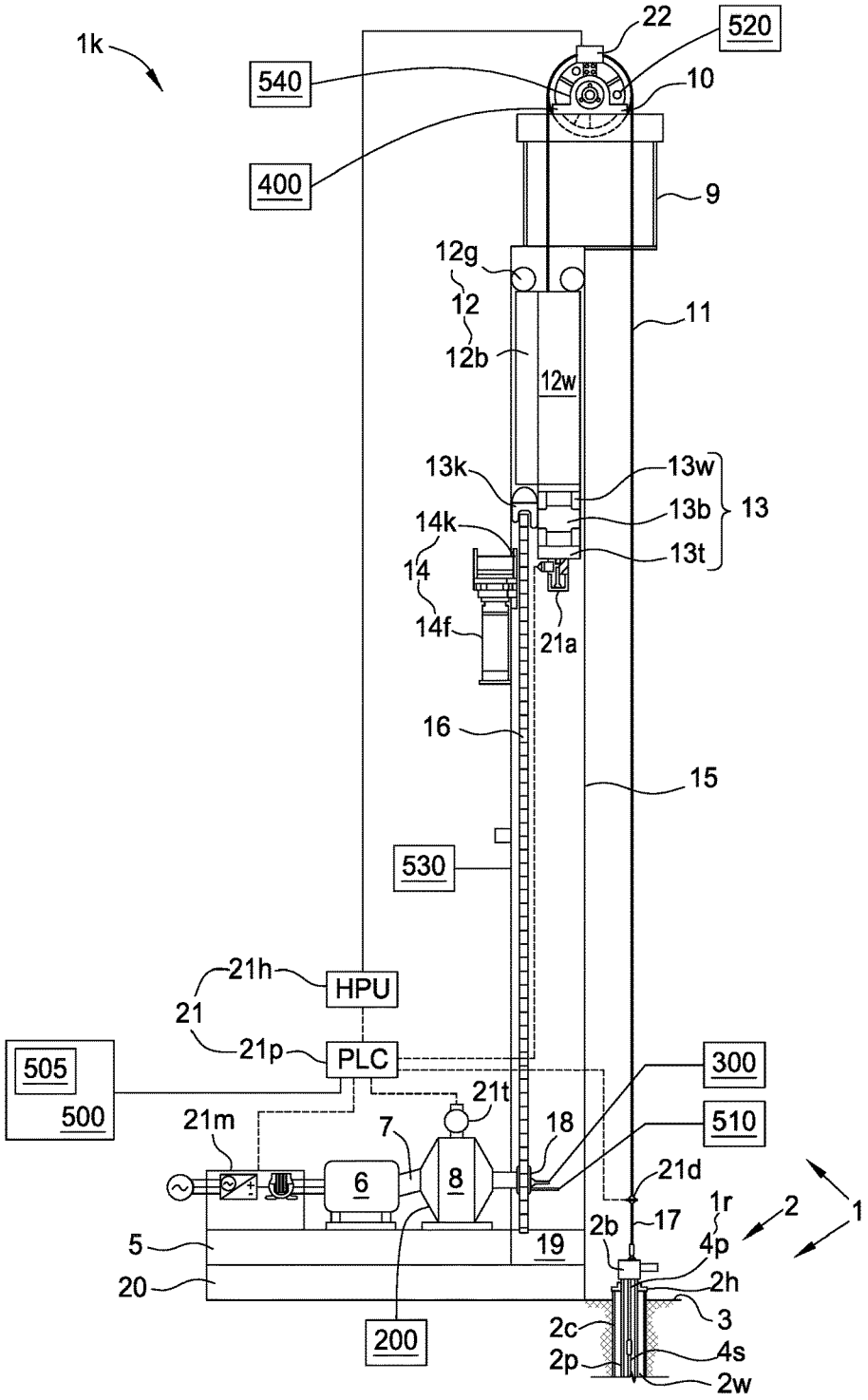
FIGS. 1A and 1B illustrate a reciprocating rod pumping unit, according to one embodiment of the present disclosure.
Figure 1B:
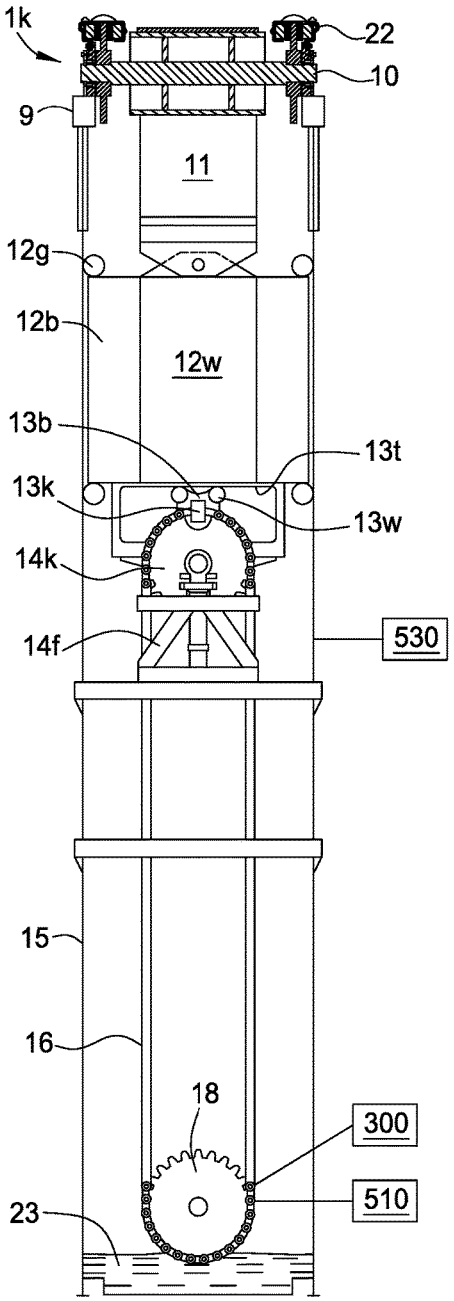

FIGS. 1A and 1B illustrate a reciprocating rod pumping unit 1*k*, according to one embodiment of the present disclosure. The reciprocating rod pumping unit 1*k* may be part of an artificial lift system 1 further including a rod string 1*r* and a downhole pump (not shown). The artificial lift system 1 may be operable to pump production fluid (not shown) from a hydrocarbon bearing formation (not shown) intersected by a well 2. The well 2 may include a wellhead 2*h* located adjacent to a surface 3 of the earth and a wellbore 2*w* extending from the wellhead. The wellbore 2*w* may extend from the surface 3 through a non-productive formation and through the hydrocarbon-bearing formation (aka reservoir).

A casing string 2*c* may extend from the wellhead 2*h* into the wellbore 2*w* and be sealed therein with cement (not shown). A production string 2*p* may extend from the wellhead 2*h* and into the wellbore 2*w*. The production string 2*p* may include a string of production tubing and the downhole pump connected to a bottom of the production tubing. The production tubing may be hung from the wellhead 2*h*.

The downhole pump may include a tubular barrel with a standing valve located at the bottom that allows production fluid to enter from the wellbore 2*w*, but does not allow the fluid to leave. Inside the pump barrel may be a close-fitting hollow plunger with a traveling valve located at the top. The traveling valve may allow fluid to move from below the plunger to the production tubing above and may not allow fluid to return from the tubing to the pump barrel below the plunger. The plunger may be connected to a bottom of the rod string 1*r* for reciprocation thereby. During the upstroke of the plunger, the traveling valve may be closed and any fluid above the plunger in the production tubing may be lifted towards the surface 3. Meanwhile, the standing valve may open and allow fluid to enter the pump barrel from the wellbore 2*w*. During the downstroke of the plunger, the traveling valve may be open and the standing valve may be closed to transfer the fluid from the pump barrel to the plunger.

The rod string 1*r* may extend from the reciprocating rod pumping unit 1*k*, through the wellhead 2*h*, and into the wellbore 2*w*. The rod string 1*r* may include a jointed or continuous sucker rod string 4*s* and a polished rod 4*p*. The polished rod 4*p* may be connected to an upper end of the sucker rod string 4*s* and the pump plunger may be connected to a lower end of the sucker rod string, such as by threaded couplings.

A production tree (not shown) may be connected to an upper end of the wellhead 2*h* and a stuffing box 2*b* may be connected to an upper end of the production tree, such as by flanged connections. The polished rod 4*p* may extend through the stuffing box 2*b*. The stuffing box 2*b* may have a seal assembly (not shown) for sealing against an outer surface of the polished rod 4*p* while accommodating reciprocation of the rod string 1*r* relative to the stuffing box.

The reciprocating rod pumping unit 1*k* may include a skid 5, a prime mover, such as an electric motor 6, a rotary linkage 7, a reducer 8, one or more ladders and platforms (not shown), a standing strut (not shown), a crown 9, a drum assembly 10, a load belt 11, one or more wind guards (not shown), a counterweight assembly 12, a carriage 13, a chain idler 14, a tower 15, a chain 16, a hanger bar 17, a drive sprocket 18, a tower base 19, a foundation 20, a control system 21, and a braking system 22. The control system 21 may include a programmable logic controller (PLC) 21*p*, a hydraulic power unit (HPU) 21*h*, a motor driver 21*m*, a tachometer 21*t*, a load cell 21*d*, and a sensor, such as accelerometer 21*a*.

The foundation 20 may support the pumping unit 1*k* from the surface 3 and the skid 5 and tower base 19 may rest atop the foundation. The PLC 21*p* and HPU 21*h* may be mounted to the skid 5 and/or the tower 15. Lubricant, such as refined and/or synthetic oil 23, may be disposed in the tower base 19 such that the chain 16 is bathed therein as the chain orbits around the chain idler 14 and the drive sprocket 18.

The electric motor 6 may be a one or more, such as three phase, electric motor. The motor driver 21*m* may be variable speed including a rectifier and an inverter. The motor driver 21*m* may receive a three phase alternating current (AC) power signal from a three phase power source, such as a generator or transmission lines. The rectifier may convert the three phase AC power signal to a direct current (DC) power signal and the inverter may modulate the DC power signal into a three phase AC power signal at a variable frequency for controlling the rotational speed of the motor 6. The PLC 21*p* may supply the desired rotational speed of the motor 6 to the motor driver 21*m* via a data link.

Alternatively, the prime mover may be an internal combustion engine fueled by natural gas available at the well site.

The motor 6 may include a stator disposed in a housing mounted to the skid 5. The rotary linkage 7 may torsionally connect a rotor of the motor 6 to an input shaft of the reducer 8 and may include a sheave connected to the rotor, a sheave connected to the input shaft, and a V-belt connecting the sheaves. The reducer 8 may be a gearbox including the input shaft, an input gear connected to the input shaft, an output gear meshed with the input gear, an output shaft connected to the output gear, and a gear case mounted to the skid 5. The output gear may have an outer diameter substantially greater than an outer diameter of the input gear to achieve reduction of angular speed of the motor 6 and amplification of torque of the motor. The drive sprocket 18 may be torsionally connected to the output shaft of the reducer 8. The tachometer 21*t* may be mounted on the reducer 8 to monitor an angular speed of the output shaft and may report the angular speed to the PLC 21*p* via a data link.

The chain 16 may be meshed with the drive sprocket 18 and may extend to the idler 14. The idler 14 may include an idler sprocket 14*k* meshed with the chain 16 and an adjustable frame 14*f* mounting the idler sprocket to the tower 15 while allowing for rotation of the idler sprocket relative thereto. The adjustable frame 14*f* may vary a height of the idler sprocket 14*k* relative to the drive sprocket 18 for tensioning the chain 16.

The carriage 13 may longitudinally connect the counterweight assembly 12 to the chain 16 while allowing relative transverse movement of the chain relative to the counterweight assembly 12. The carriage 13 may include a block base 13*b*, one or more (four shown) wheels 13*w*, a track 13*t*, and a swivel knuckle 13*k*. The track 13*t* may be connected to a bottom of the counterweight assembly 12, such as by fastening. The wheels may be engaged with upper and lower rails of the track 13*t*, thereby longitudinally connecting the block base 13*b* to the track 13*t* while allowing transverse movement therebetween. The swivel knuckle 13*k* may include a follower portion assembled as part of the chain 16 using fasteners to connect the follower portion to adjacent links of the chain. The swivel knuckle 13*k* may have a shaft portion extending from the follower portion and received by a socket of the block base 13*b* and connected thereto by bearings (not shown) such that swivel knuckle 13*k* may rotate relative to the block base 13*b*.

Figure 2A:
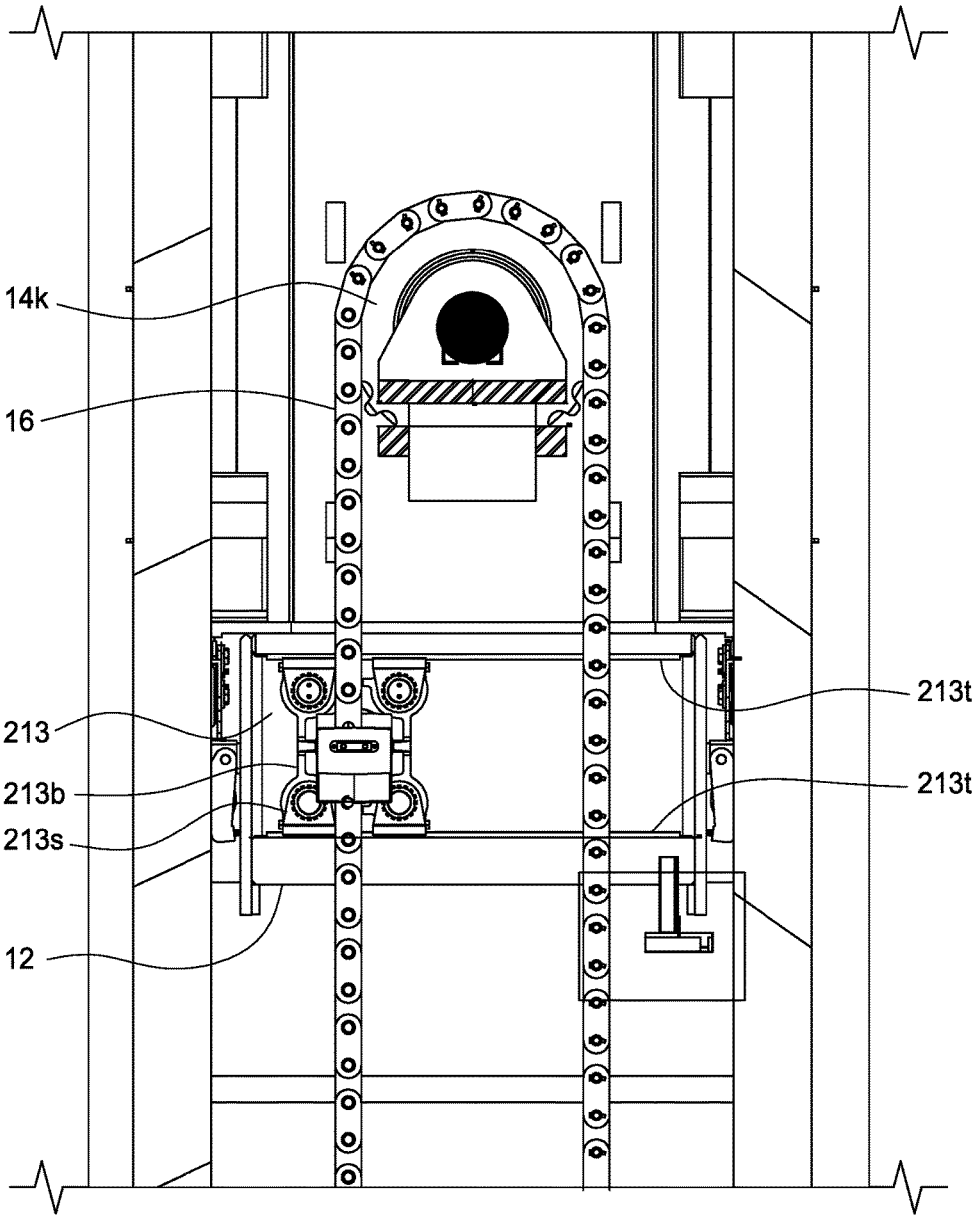
FIG. 2A is a partial perspective view of an exemplary carriage coupled to a chain and a counterweight.
Figure 2B:
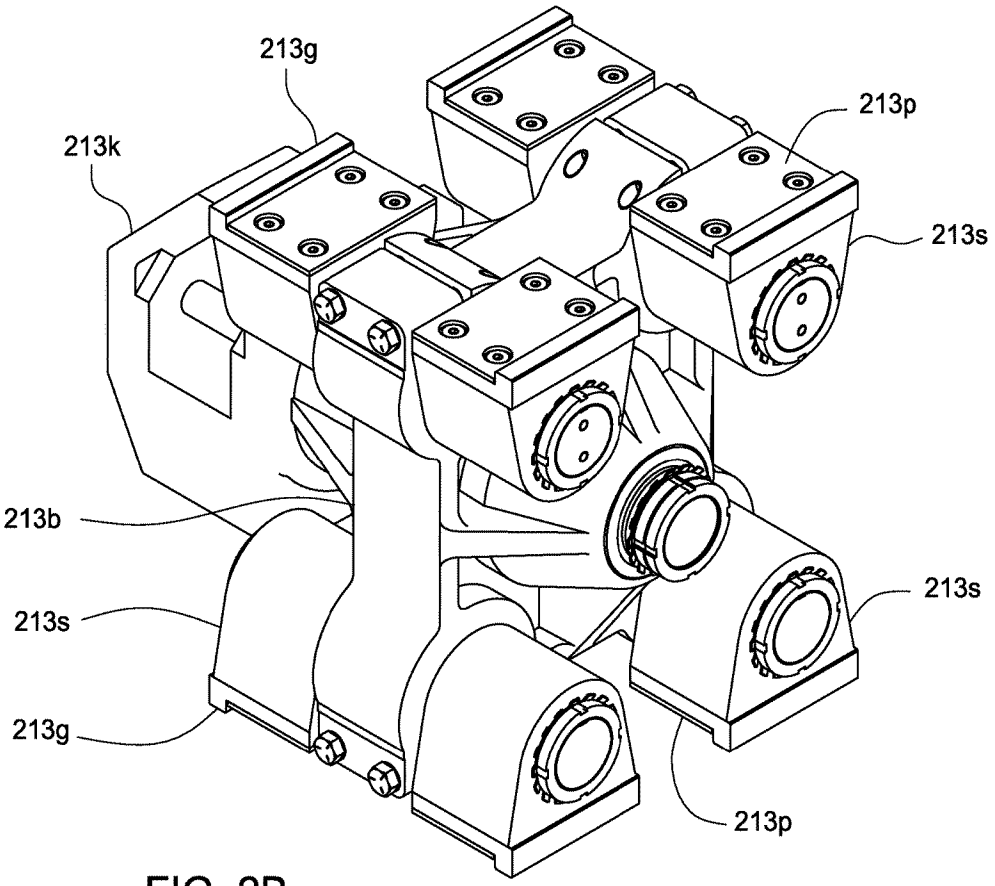
FIG. 2B is a perspective view of the carriage of FIG. 2A.

FIGS. 2A and 2B illustrate another embodiment of a carriage 213. FIG. 2A is a partial perspective view of the carriage 213 coupled to the chain 16 and the counterweight 12 and located near the idler sprocket 14*k*. FIG. 2B is a perspective view of the carriage 213. The carriage 213 may longitudinally connect the counterweight assembly 12 to the chain 16 while allowing relative transverse movement of the chain 16 relative to the counterweight assembly 12. The carriage 213 may include a block base 213*b*, one or more (eight shown) slide bearings 213*s*, two tracks 213*t*, and a swivel knuckle 213*k*. Upper and lower tracks 213*t* may be connected to the counterweight assembly 12, such as by fastening. The sliding bearings 213*s* may engage the rails of the upper and lower tracks 213*t*, thereby longitudinally connecting the block base 213*b* to the tracks 213*t* while allowing transverse movement between the counterweight 12 and the chain 16. As shown, the four slide bearings 213*s* engage the rail of the upper track 213*t*, and four slide bearings 213*s* engage the rail of the lower track 213*t*. However, it is contemplated that either or both tracks 213*t* may have one, two, four, or more slide bearings 213*s* engaged therewith. In one embodiment, the slide bearings 213*s* engage the tracks 213*t* without lubricant therebetween. Each slide bearing 213*s* may include a metal plate 213*p* engaged with the rail of the tracks 213*t*. In one embodiment, the metal plate 213*p* includes bronze and/or graphite and a steel backing. As shown, a bearing guide 213*g* is provided on the edge of the slide bearings 213*s* to keep the slide bearings 213*s* on the tracks 213*t*.

Figure 3A:
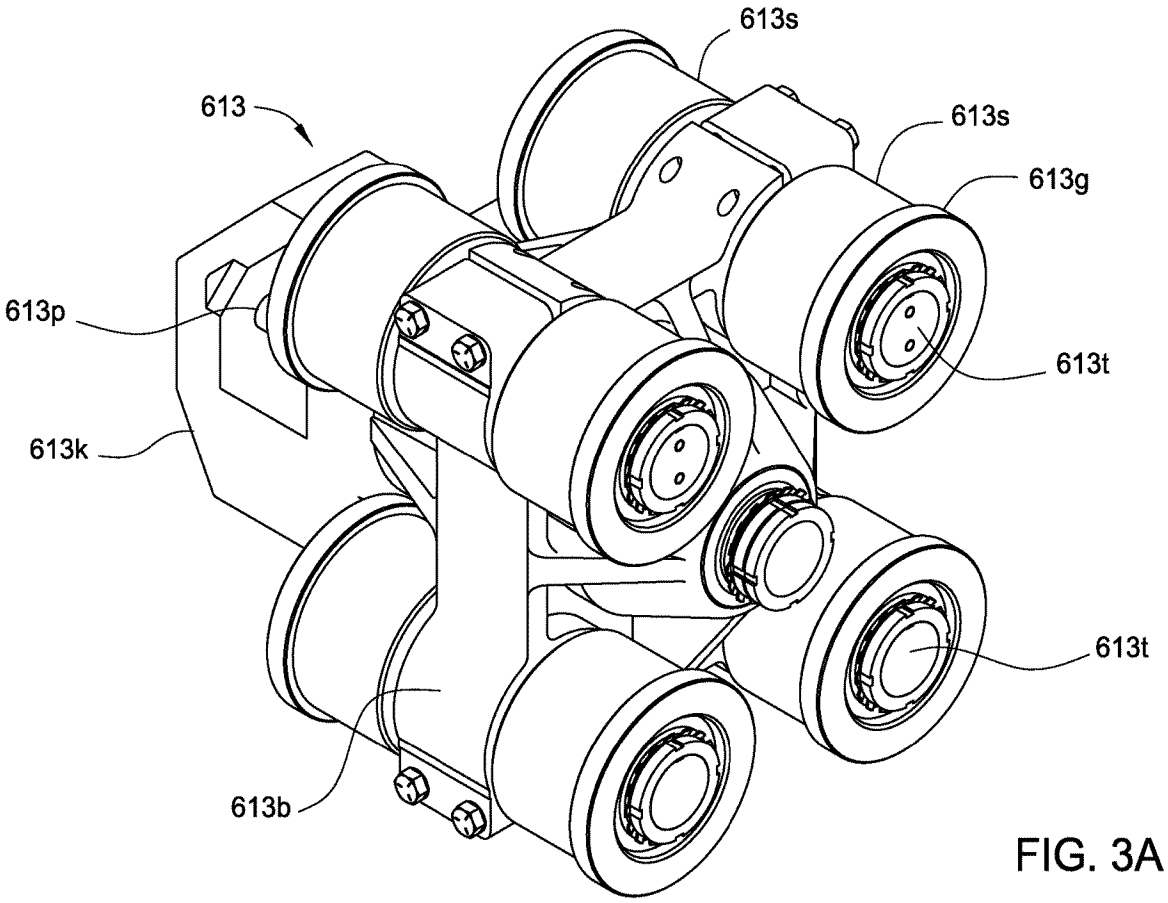
FIGS. 3A-3E illustrate another embodiment of a carriage.
Figure 3C:
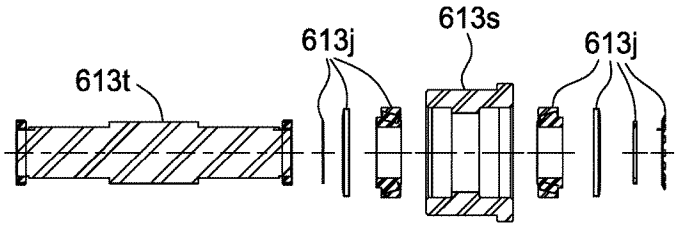
Figure 3D:
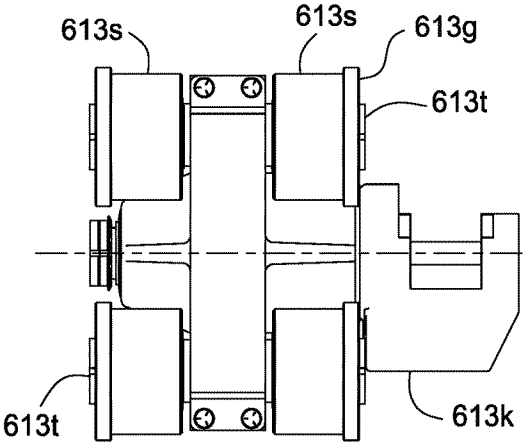
Figure 3B:
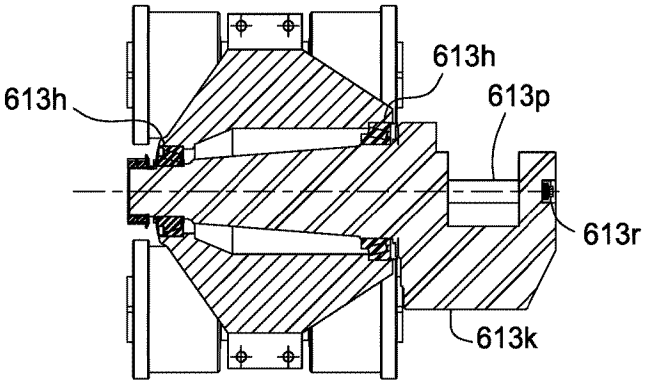
Figure 3E:
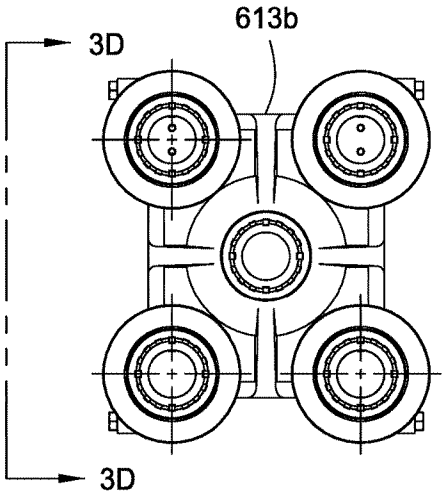

FIGS. 3A-3E illustrate another embodiment of a carriage 613. The carriage 613 may include bushings 613*s* in place of the sliding bearings 213*s*. FIG. 3A is a perspective view of the carriage 613, and FIG. 3B is a cross-sectional view of the carriage 613. FIG. 3C is a cross-sectional view of the bushing 613*s* and bushing shaft 613*t*. FIGS. 3D-3E are different perspective views of the carriage 613. The carriage 613 may longitudinally connect the counterweight assembly 12 to the chain 16 while allowing relative transverse movement of the chain 16 relative to the counterweight assembly 12. The carriage 613 may include a block base (also referred to as "housing") 613*b*, one or more (eight shown) bushings 613*s*, two tracks that are similar to tracks 13*t*, and a swivel knuckle 613*k*. Upper and lower tracks may be connected to the counterweight assembly 12, such as by fastening. The swivel knuckle 613*k* is rotationally coupled to the housing 613*b* using one or more bearings 613*h*, as shown in FIG. 3B. The chain 16 may be coupled to the swivel knuckle 613*k* via the chain pin 613*p*. The chain pin 613*p* may be attached to the swivel knuckle 613*k* using a pin retainer 613*r*. The bushings 613*s* are rotationally coupled to the housing 613*b* via a bushing shaft 613*t*. The bushing shaft 613*t* may extend across the housing 613*b* to support a bushing 613*s* on each side of the housing 613*b*. Referring to FIG. 3C, one or more bearing assemblies 613*j* are used to facilitate relative rotation between the bushings 613*s* and the bushing shaft 613*t*. The bushings 613*s* may engage the rails of the upper and lower tracks, thereby longitudinally connecting the housing 613*b* to the tracks while allowing transverse movement between the counterweight 12 and the chain 16. As shown, a bushing guide 613*g* is provided on the edge of the bushings 613*s* to keep the bushings 613*s* on the tracks. As shown, the four bushings 613*s* engage the rail of the upper track, and four bushings 613*s* engage the rail of the lower track. However, it is contemplated that either or both tracks may have one, two, four, or more bushings 613*s* engaged therewith. In one embodiment, the bushings 613*s* engage the tracks 613*t* without lubricant therebetween.

Referring back to FIGS. 1A and 1B, the counterweight assembly 12 may be disposed in the tower 15 and longitudinally movable relative thereto. The counterweight assembly 12 may include a box 12*b*, one or more counterweights 12*w* disposed in the box, and guide wheels 12*g*. Orthogonally oriented guide wheels 12*g* may be connected at each corner of the box 12*b* for engagement with respective guide rails of the tower 15, thereby transversely connecting the box to the tower. The box 12*b* may be loaded with counterweights 12*w* until a total balancing weight corresponding to the weight of the rod string 1*r* and/or the weight of the column of production fluid, such as equal to the weight of the rod string 1*r* plus one-half the weight of the fluid column.

Figure 1C:
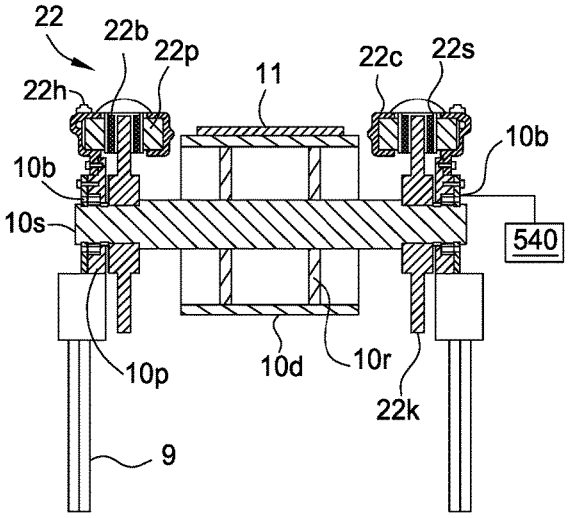
FIG. 1C illustrates a braking system of the reciprocating rod pumping unit.

FIG. 1C illustrates the braking system 22. The crown 9 may be a frame mounted atop the tower 15. The drum assembly 10 may include a drum 10*d*, a shaft 10*s*, one or more (pair shown) ribs 10*r* connecting the drum to the shaft, one or more (pair shown) pillow blocks 10*p* mounted to the crown 9, and one or more (pair shown) bearings 10*b* for supporting the shaft from the pillow blocks while accommodating rotation of the shaft relative to the pillow blocks. The braking system 22 may include one or more (pair shown) disk brakes. Each disk brake may include a disk 22*k* disposed around and torsionally connected to the shaft 10*s*, a caliper 22*c* mounted to the respective pillow block 10*p*, one or more (pair shown) pistons 22*p* disposed in a respective chamber formed in the respective caliper, and a brake pad 22*b* connected to each piston 22*p*. Each piston 22*p* may be movable relative to the respective caliper 22*c* between an engaged position (not shown) and a disengaged position (shown). The brake pads 22*b* may be clear of the respective disks 22*k* in the disengaged position and pressed against the disks in the engaged position, thereby torsionally connecting the shaft 10*s* to the pillow blocks 10*p*. Each piston 22*p* may be biased toward the disengaged position by a square-cut seal (shown) or a return spring (not shown). Each caliper 22*c* may have a hydraulic port 22*h* in fluid communication with the respective piston chambers. A hydraulic flow line may have a lower end connected to the HPU manifold and upper ends connected to the caliper ports 22*h*. Supply of pressurized brake fluid to the caliper chambers by the HPU 21*h* may exert fluid force on the pistons 22*p*, thereby moving the pistons to the engaged position against the bias of the square-cut seals.

Alternatively, drum brakes may be used instead of the disk brakes. Alternatively, the braking system 22 may be pneumatically operated.

Figure 1D:
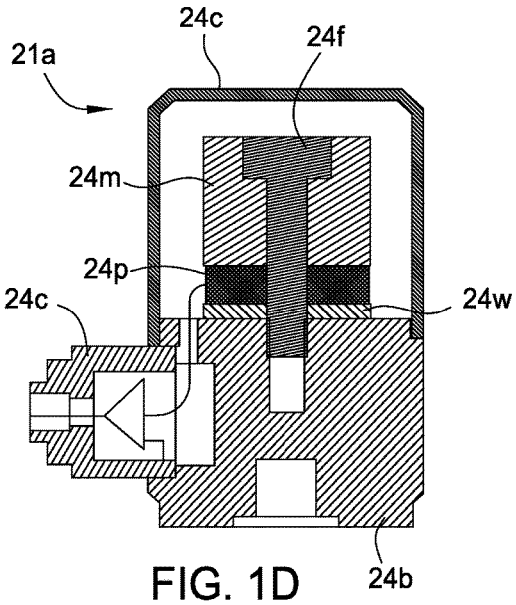
FIG. 1D illustrates an accelerometer of the reciprocating rod pumping unit.

FIG. 1D illustrates the optional accelerometer 21*a*. The accelerometer 21*a* may be mounted to a bottom of the carriage track 13*t* for sensing free fall of the counterweight assembly 12 due to failure of the rod string 1*r*. The accelerometer 21*a* may include a cap 24*c*, a body 24*b*, a fastener 24*f*, an inertia mass 24*m*, a sensing element, such as a piezoelectric crystal 24*p*, a washer 24*w*, and a circuit 24*c*. The fastener 24*f* may be threaded for engaging a threaded socket formed in the body 24*b* to retain the inertia mass 24*m*, the piezoelectric crystal 24*p*, and the washer 24*w* thereto. The preload on the fastener 24*f* may also be used to calibrate the piezoelectric crystal 24*p*. The body 24*b* may also have a second threaded socket formed therein for receiving a threaded fastener (not shown) to mount the body to the carriage track 13*t*. The circuit 24*c* may include a housing connected to the body 24*b* and an amplifier disposed therein and in electrical communication with the piezoelectric crystal 24*p*. The amplifier may be in electrical communication with the PLC 21*p* via a flexible cable. The flexible cable may supply a power signal to the amplifier from the PLC 21*p* while also providing data communication therebetween and accommodating reciprocation of the counterweight assembly 12 relative to the PLC.

Alternatively, a battery and wireless data link may be mounted to the bottom of the carriage track 13*t*. The battery may be in electrical communication with the accelerometer 21*a* and the wireless data link for supplying power thereto. The wireless data link may be in data communication with the accelerometer 21*a* for transmitting measurements therefrom to a wireless data link of the PLC 21*p*. Alternatively, the accelerometer 21*a* may be magnetostrictive, servo-controlled, reverse pendular, or microelectromechanical (MEMS).

The PLC 21*p* may be programmed to monitor the accelerometer 21*a* for a threshold measurement indicative of failure of the rod string 1*r*. The threshold measurement may be substantially greater than routine downward acceleration experienced by the counterweight assembly 12 during normal operation of the pumping unit 1*k*. The threshold acceleration may be greater than or equal to one-half, two thirds, or three-quarters of the standard acceleration of the Earth's gravity. Should the PLC 21*p* detect the threshold acceleration measured by the accelerometer 21*a*, the PLC may operate a manifold of the HPU 21*h* to supply pressurized brake fluid to the braking system 22, thereby engaging the braking system to halt downward movement of the counterweight assembly 12. Advantageously, using the accelerometer 21*a* instead of the tachometer 21*t* to detect failure of the rod string 1*r* reduces latency in the detection time, which would otherwise allow the counterweight assembly 12 to accrue kinetic energy which would have to be dissipated by the braking system 22.

The PLC 21*p* may be in data communication with a home office (not shown) via long distance telemetry (not shown). The PLC 21*p* may report failure of the rod string 1*r* to the home office and maintain engagement of the braking system 22 until a workover rig (not shown) may be dispatched to the well site to repair the rod string 1*r*.

Returning to FIGS. 1A and 1B, the load belt 11 may have a first end longitudinally connected to a top of the counterweight box 12*b*, such as by a hinge, and a second end longitudinally connected to the hanger bar 17, such as by wire rope. The load belt 11 may extend from the counterweight assembly 12 upward to the drum assembly 10, over an outer surface of the drum 10*d*, and downward to the hanger bar 17. The hanger bar 17 may be connected to the polished rod 4*p*, such as by a rod clamp, and the load cell 21*d* may be disposed between the rod clamp and the hanger bar. The load cell 21*d* may measure tension in the rod string 1*r* and report the measurement to the PLC 21*p* via a data link.

In operation, the motor 6 is activated by the PLC 21*p* to torsionally drive the drive sprocket 18 via the linkage 7 and reducer 8. Rotation of the drive sprocket 18 drives the chain 16 in an orbital loop around the drive sprocket and the idler sprocket 14*k*. The swivel knuckle 13*k* follows the chain 16 and resulting movement of the block base 13*b* along the track 13*t* translates the orbital motion of the chain into a longitudinal driving force for the counterweight assembly 12, thereby reciprocating the counterweight assembly along the tower 15. Reciprocation of the counterweight assembly 12 counter-reciprocates the rod string 1*r* via the load belt 11 connection to both members.

In one embodiment, the pumping unit 1*k* may include a speed monitor system 500 to facilitate operation of the pumping unit 1*k*. The speed monitor system 500 may be configured to protect the pumping unit 1*k* by monitoring and controlling one or more devices on the pumping unit 1*k*. Exemplary devices include a lubrication system 300, a brake system 200, speed sensors, load cell 400, and belt alignment switch. By monitoring one or more of these devices, the speed monitor system 500 may be able to identify conditions such as rod part, stuck pump, excessive vibration, speed and acceleration of the pumping unit, lubrication errors such as low lubricator level, and other conditions that may damage the pumping unit 1*k*. The speed monitor system 500 may be operated as an add-on to or integrated with the PLC 21*p* of the pumping unit 1*k*.

In one embodiment, the speed monitor system 500 includes a programmable logic controller ("SMS PLC") 505, an integrated power supply, input circuits, and output circuits disposed in a housing. The speed monitor system 500 may include a PROFINET port for communication over a PROFINET network and an optional load cell conditioner. The speed monitor system 500 is equipped with a display that may function as a touch screen interface.

Figure 4:
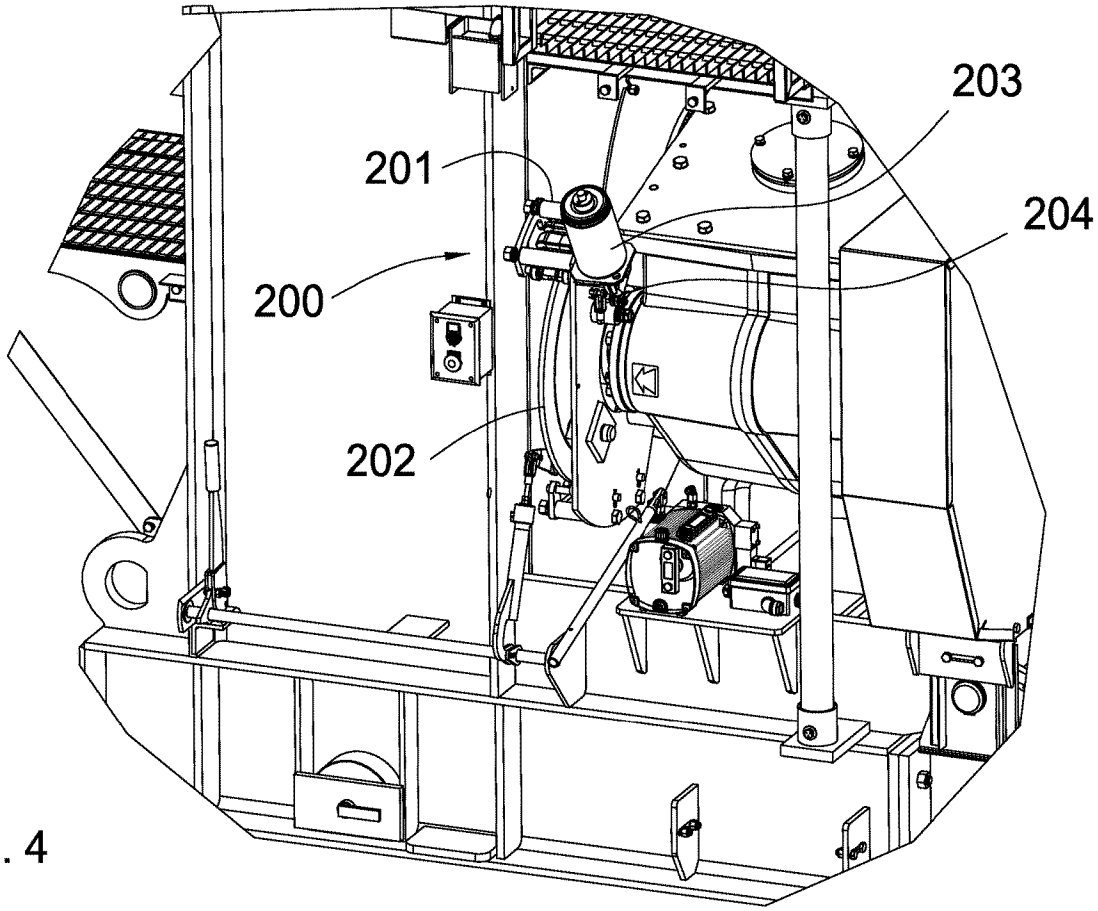
FIG. 4 illustrates an exemplary brake system coupled to a reducer.
Figure 5A:
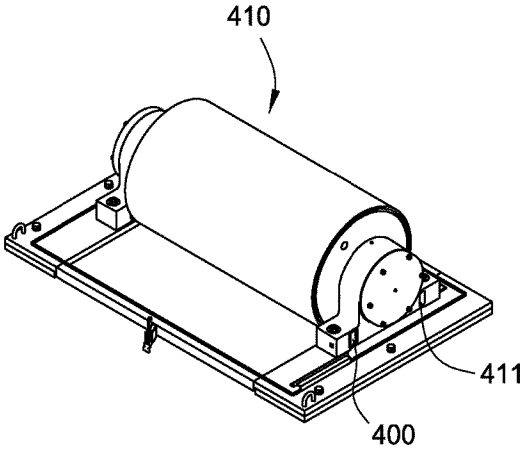
FIGS. 5A-5E show an exemplary embodiment of a pillow block equipped with a load cell.
Figure 5D:
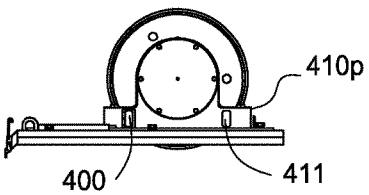
Figure 5B:
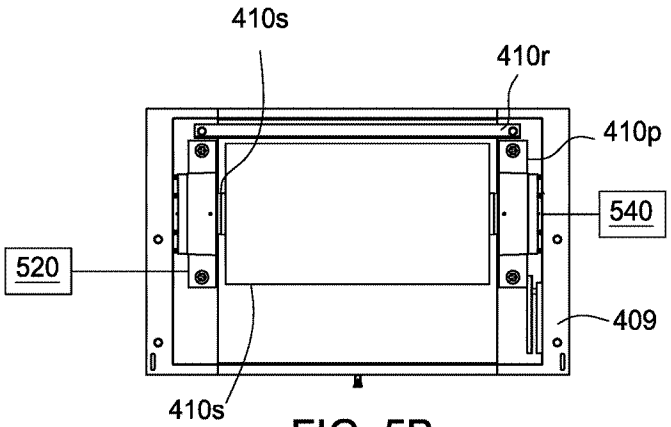
Figure 5C:
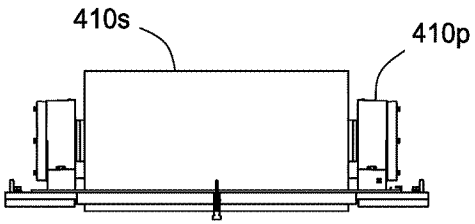
Figure 5E:
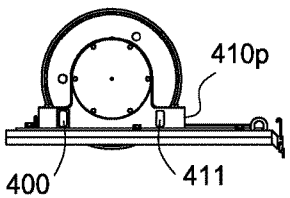

In one embodiment, an optional brake system 200 may be coupled to the reducer 8, as illustrated in FIG. 4. The brake system 200 includes one or more disk brakes 201. In the example of FIG. 4, the disk brake 201 includes a disk 202 rotationally coupled to the input shaft of the reducer 8, such as by fastening. Alternatively, the disk 202 and the input shaft may be integrally formed. In another embodiment, the disk 202 is coupled, or integral, with the output shaft. The disk brake 201 includes a caliper and a piston 204 located in a cylinder housing 203. The caliper may be actuated by the piston 204 to urge the brake pads between an engaged position with the disk 202 and a disengaged position with the disk 202. In the disengaged position, the brake pads are clear of the disk 202. In the engaged position, the brake pads engage the disk 202, thereby restricting the rotational movement of the disk 202. In turn, the disk 202 restricts the rotational movement of the input shaft.

In one embodiment, the brake system 200 is spring-activated. For example, a spring, or other suitable bias members, may be disposed in the housing 203 and arranged to bias the piston 204. The spring is configured to bias the piston 204 and the brake pads towards the engaged position. In one embodiment, the cylinder housing 203 includes a hydraulic port in fluid communication with a hydraulic flow line connected to the HPU manifold. Supply of hydraulic fluid to the cylinder housing 203 by the HPU 21*h* exerts a fluid force on the piston 204. When the fluid force on the piston 204 is greater than a bias force provided by the biasing member, the piston 204 moves towards the disengaged position. When the bias force on the piston 204 is greater than fluid force, the piston 204 moves toward the engaged position. An exemplary spring actuated brake system is disclosed in U.S. Pat. No. 5,033,592, assigned to Hayes Industrial Brake, Inc.

During operation of the pumping unit 1*k*, hydraulic fluid is supplied to the cylinder housing 203 such that the fluid force is greater than the bias force and, as a result, the piston 204 remains in the disengaged position. Upon encountering a triggering event, such as a rod part or some other failure, the speed monitor system 500 sends an electrical signal to relieve the hydraulic fluid in the cylinder housing 203 such that the bias force overcomes the resulting fluid force. In turn, the spring moves the piston 204 (and the brake pad) against the disk 202, thereby stopping the rotation of the drive sprocket 18 and stopping the downward movement of the counterweight 12*w*. In one embodiment, the brake system 200 moves the piston 204 into the engaged position within 0.2 seconds to 1.0 seconds, such as 0.5 seconds, of a rod part. Alternatively, the brake system 200 is pneumatically operated. It is contemplated this brake system 200 may be used in conjunction with, or as an alternative to, the brake system 22 coupled to the drum assembly 10.

In one embodiment, the brake system 200 may utilize a cylinder that is primed to a predetermine pressure so that there is sufficient pressure to actuate the piston. In this respect, the brake system may include an optional pressure sensor such as a pressure transducer to measure the pressure in the cylinder. For example, either or both of the brake systems 22, 200 may be equipped with this pressure sensor. If a measured pressure is at or below the minimum pressure needed to actuate the piston, then the speed monitor system 500 may send a warning to the operator or stop the pumping unit 1*k*.

In yet another embodiment, the brake system 200 may include one or more sensors for determining the position of the brake pads relative to the disk 22*k*, 202. The position data may be used to prevent the brake pads from touching the disks 22*k*, 202, thereby preventing inadvertent wear down of the brake pads.

In one embodiment, one or more pillow blocks 10*p* are configured to provide a measurement of a change in load on the drum 10*d*. For example, the pillow block 10*p* is instrumented to provide a measurement of the change in load. FIGS. 5A-E show an exemplary embodiment of a drum assembly 410 equipped with a load cell 400 disposed in the pillow block 410*p*. The drum assembly 410 includes a drum 410*d*, a shaft 410*s*, one or more (pair shown) pillow block 310*p* mounted to a top plate 409 of the crown 9. Bearings may be used to facilitate rotation of the shaft 410*s* in the pillow block 410*p*. An optional belt retainer 410*r* may be counted on the top plate 409 to retain the position of the belt 11. At least one of the pillow blocks 410*p* may be configured to receive the load cell 400. As shown, each of the pillow blocks 410*p* is equipped with two openings 411 for receiving a load cell 400. In this example, only one load cell 400 has been positioned in each pillow block 410*p*. The load cell 400 is configured to measure a change in load exerted on the drum 10*d* by the load belt 11. An exemplary load cell 400 is a strain gage. A suitable strain gage is an Under Pillow Block Washdown-Duty load cell commercially available from Cleveland Motion Controls, a Lincoln Electric Company.

In the event of a rod part, the load exerted by the load belt 11 on the drum 10*d*, and thus the pillow block 410*p*, will rapidly decrease. In turn, the load cell 400 recognizes the change in load and transmits a signal to the PLC 21*p* or the speed monitor system 500 to stop operation of the pumping unit 1*k*. The signal may be transmitted via an electric cable or wirelessly. For example, after receiving the signal, the speed monitor system 500 may activate the brake system 200 to stop rotation of the sprocket 18, thereby stopping the free fall of the counterweight 12*w*. It is contemplated that any location of the pumping unit 1*k* can be provided with a strain gage to sense a rapid loss of load on the drum 10*d*. In another embodiment, the speed monitor system 500 may be programmed to automatically stop the pumping unit 1*k* in response to a measured load. For example, the speed monitor system 500 may have a default setting to stop the pumping unit 1*k* if the measured load is within 5% or within 10% of the maximum load capacity. Additionally, or alternatively, the operator may set a load limit such that the pumping unit 1*k* will be stopped when the load limit is reached.

In one embodiment, the reciprocating rod pumping unit 1*k* includes a lubrication system 300. The lubrication system 300 is configured to apply lubricant, such as refined oil, synthetic oil, and/or grease, to the chain 16 and/or bearings in the pumping unit 1*k* during artificial lift operations. The lubrication system 300 may include a pump configured to move lubricant from a lubricant tank to the applicators 302. A centralized lubrication manifold may be used to distribute the lubricant to the various applicators 302.

Figure 6:
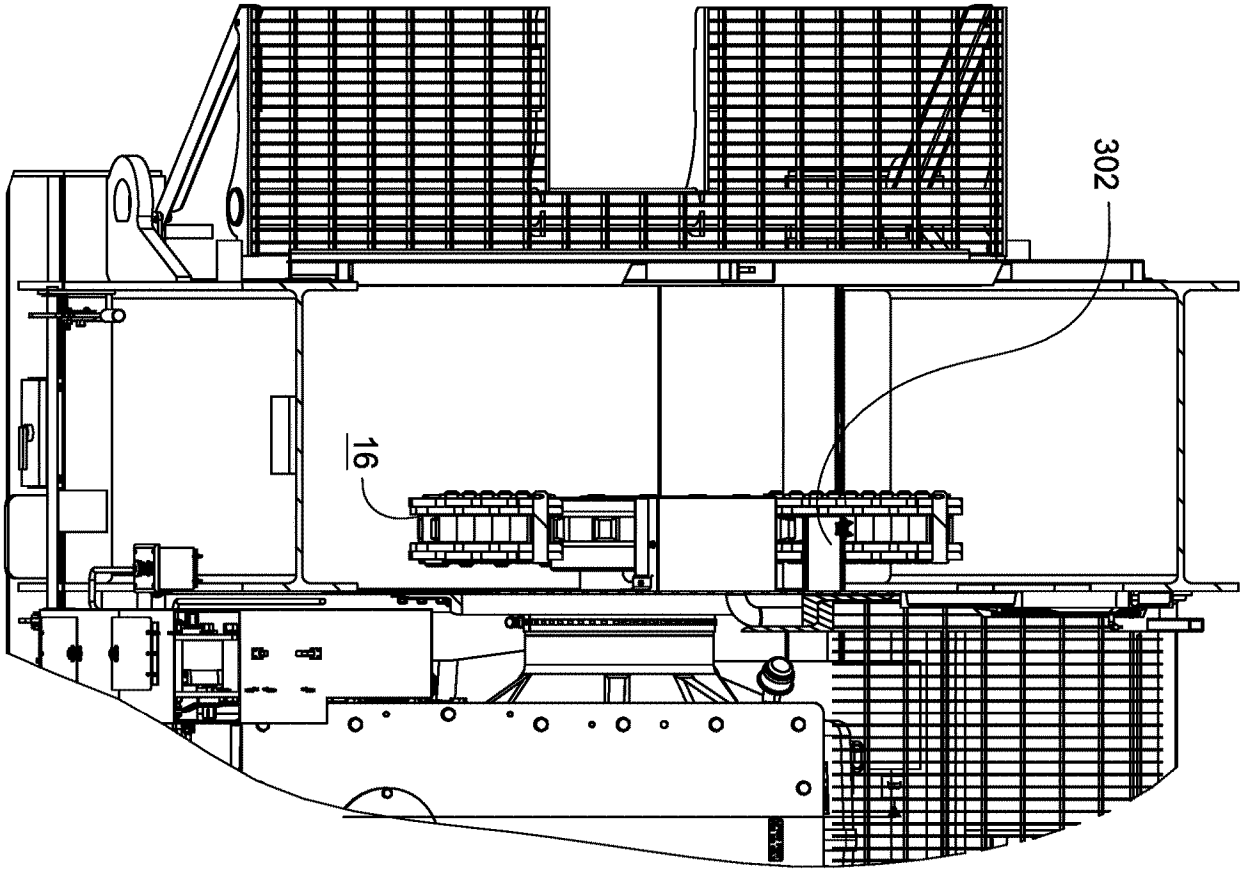
FIG. 6 shows an exemplary location of a nozzle of the lubrication system.

The lubrication system 300 includes one or more applicators 302 positioned adjacent the chain 16 or the bearings. Exemplary applicators 302 include one or more nozzles, brushes, sponges, fittings, and combinations thereof. One or more applicators, such as nozzles, may be positioned at multiple locations of the pumping unit 1*k*. The nozzles 302 may be positioned at any appropriate position on the pumping unit 1*k* such that lubricant can be applied to the chain 16 during operation of the pumping unit 1*k*. FIG. 6 shows an exemplary location of a nozzle for lubricating the chain 16. In one example, the nozzles 302 are positioned on the idler 14 of the pumping unit 1*k*. In another example, the nozzles 302 are positioned on the tower base 19 to apply lubricant to the chain 16 and the sprocket 18. In another example, grease may be applied to the bearings using a centralized grease distribution system or grease fittings at predetermined locations.

Operation of the lubrication system 300 is controlled by the speed monitor system 500. The speed monitor system 500 controls the duration, frequency intervals, and amount of lubricant provided to the applicators 302. The lubrication system 300 is configured to apply lubricant at regular intervals. In one embodiment, the lubrication system 300 applies lubricant at intervals between 20 minutes and 40 minutes, such as 30 minute intervals. The lubrication system 300 applies lubricant for a predetermined duration. For example, the predetermined duration is between 30 seconds and 2 minutes, such as 1 minute.

In one embodiment, the speed monitor system 500 periodically monitors movement of the pump piston. For example, the speed monitor system monitors the pump piston using a proximity switch located inside the lubrication pump and configured to detect the pump piston. When the pump is active, the speed monitor system 500 may read the proximity switch at 30 minute intervals; at 15 to 45 minute intervals; 30 to 90 minute intervals; or 15 to 300 minute intervals. In one example, during each interval, the speed monitor system 500 may read the proximity switch for 0.3 seconds of each second for a period of 30 seconds. If movement of the pump piston is not detected, the speed monitor system 500 may trigger an alarm. If the pump piston is still not detected after a longer period of time, such as after twenty-four hours, the speed monitor system 500 may shut down the lubrication system 300. The lubrication system 300 may optionally include lubrication sensors configured to determine the amount of the lubricant in the lubrication tank. Pressure sensors may optionally be provided to monitor the pressure of oil in the lubrication system to ensure the pressure is sufficient for the applicator 302 to supply the lubricant. A flow meter may optionally be provided to measure the flow rate of the lubricant. The sensors are configured to communicate sensed data to the speed monitor system 500 via an electronic cable or wirelessly.

In another embodiment, the speed monitor system 500 is configured to provide overspeed protection of the pumping unit 1*k*. In one embodiment, one or more proximity sensors 510 may be provided at the lower end of the tower 15 to monitor the speed of the belt 11. An exemplary proximity sensor is a Hall effect sensor or any proximity sensor suitable for measuring the speed of the lower sprocket 18, chain 16, and the brake disk 202. In one example, the pulse signals from a rotating target wheel are counted to determine the speed of the belt 11. If the speed of the belt 11 is above a predetermined limit, then the speed monitor system 500 will stop the pumping unit 1*k*. Optionally, the position of the belt 11 may be determined from the pulse signals and illustrated on a display.

In another embodiment, one or more proximity sensors 520 may be located at an upper end of the tower 15 to monitor the time required to complete a cycle of the belt 11. If the belt 11 does not complete the cycle in a predetermined number of pulses, more time may be added to allow for tolerances. For example, between 5 percent and fifteen percent of the cycle time may be added. If the cycle is not completed within this extra number of pulses, then the speed monitor system 500 will stop the pumping unit 1*k*. If the pumping unit 1*k* is stopped, the speed monitor system 500 may optionally turn on a stop indicator lamp and log the alarm.

In another embodiment, the proximity sensors 510 located at the lower end of the tower 15 may be used to monitor acceleration of the belt 16. For example, the pulse signals from these proximity sensors 510 can be used to calculate the speed of the belt 16, which can be converted to acceleration by determining the change in speed over time. If the acceleration is above a predetermined limit or is outside a predetermined acceleration range, the speed monitor system 500 may stop the pumping unit 1*k*. In another embodiment, both a warning limit and an upper limit may be set to monitor acceleration. In one example, the upper limit is set at a threshold value indicative of a rod part condition. The threshold value may be substantially greater than routine downward acceleration experienced by the counterweight assembly 12 during normal operation of the pumping unit 1*k*. The threshold acceleration may be greater than or equal to one-half, two thirds, or three-quarters of the standard acceleration of the Earth's gravity. Should the SMS PLC 505 detect the threshold value as calculated from the measured speed of the belt 16, the speed monitor system 500 may activate the brake system 200 to stop free-fall of the counterweight 12*w*. In particular, the SMS PLC 505 may relieve hydraulic pressure in the cylinder to allow the spring to urge the brake pads into engagement with the brake disk 202, thereby stopping rotation of the input shaft of the reducer 8. Alternatively, SMS PLC 505 may send a signal to the PLC 21*p* to operate a manifold of the HPU 21*h* to supply pressurized brake fluid to the braking system 22, thereby engaging the braking system 22 to halt downward movement of the counterweight assembly 12.

In yet another embodiment, the expected acceleration necessary to stop the counterweight 12*w* can be calculated from the measured velocities. The speed monitor system 500 may pre-emptively stop the pumping unit 1*k* if the acceleration necessary to stop the counterweight 12*w* is above a predetermined safe limit.

In another embodiment, a belt alignment sensor 530 may be provided to measure the sway of the belt 16 relative to its vertical axis, as shown in FIG. 1B. An exemplary alignment sensor is a capacitance sensor. The alignment sensor 530 may be positioned at predetermined outer limits of the sway of the belt 16 and configured to monitor the belt's 16 presence at these outer limits. For example, one alignment sensor 530 may be positioned on the left and right outer limits of the allowable sway range of the belt 16. If the belt 16 moves into the monitored areas, the speed monitor system 500 may stop the pumping unit 1*k*.

In yet another embodiment, the tower 15 may be provided with one or more vibration sensors 540 to determine the amount of vibration on the tower 15, as shown in FIG. 1C. Any suitable vibration sensors known may be used. In one example, the vibrations sensors 540 may be a normally open vibration switch. When the vibration is within an acceptable range, the vibration sensor 540 remains open. The vibration sensor 540 will close when the vibration is outside of the acceptable range or above a predetermined limit. If this occurs, a signal may be sent to the speed monitor system 500 to shut down the pumping unit 1*k*, such as by activating the brake system 200 as discussed above. Optionally, the speed monitor system 500 can log the alarm.

In yet another embodiment, the temperature of the bearings 10*b* supporting the drum 10*d* may be monitored to prevent overheating. For example, one or more temperature sensors 550 may be used to monitor the temperature of the bearings 10*b*. If the temperature is above an acceptable temperature limit, then the speed monitor system 500 may shut down the pumping unit 1*k* such as by activating the brake system 200 as discussed above. Optionally, the speed monitor system 500 can log the alarm.

In yet another embodiment, the pumping unit 1*k* may include an emergency stop switch. The emergency stop switch may be activated by the PLC 21*p*, the speed monitor system 500, an operator, or any other suitable controller capable of detecting a faulty condition on the pumping unit 1*k*. The emergency stop switch may be located at any suitable location on or proximate the pumping unit 1*k*.

In one embodiment, a reciprocating rod pumping unit includes a tower; a counterweight assembly movable along the tower; a drum connected to an upper end of the tower and rotatable relative thereto; a belt having a first end connected to the counterweight assembly, extending over the drum, and having a second end connectable to a rod string; a prime mover for reciprocating the counterweight assembly along the tower; a sensor for detecting a condition of the pumping unit; a brake system for halting free-fall of the counterweight assembly; and a controller in communication with the sensor and operable to activate the brake system in response to detection of the faulty condition of the pumping unit.

In another embodiment, a reciprocating rod pumping unit includes a tower; a counterweight assembly movable along the tower; a drum connected to an upper end of the tower and rotatable relative thereto; a belt having a first end connected to the counterweight assembly, extending over the drum, and having a second end connectable to a rod string; a prime mover for reciprocating the counterweight assembly along the tower; a sensor for detecting a condition of the pumping unit; and a controller in communication with the sensor and operable to cause the counterweight assembly to stop in response to the detected condition.

In another embodiment, a reciprocating rod pumping unit includes a tower; a counterweight assembly movable along the tower; a drum connected to an upper end of the tower and rotatable relative thereto; a belt having a first end connected to the counterweight assembly, extending over the drum, and having a second end connectable to a rod string; a prime mover for reciprocating the counterweight assembly along the tower; a lubrication system for applying lubricant to at least one of a chain, a bearing, and combinations thereof; at least one of a lubrication sensor for detecting an amount of lubricant in the lubrication system, a pressure sensor for detecting a pressure in the lubrication system, and a flow meter for measuring a flow rate of the lubricant; and a controller in communication with the at least one of the lubrication sensor, the pressure sensor, and the flow meter, and operable to cause the counterweight assembly to stop.

In one or more of the embodiments described herein, the sensor is one of a speed sensor for detecting a speed of the belt; a cycle sensor for detecting a cycle of the belt; a load sensor for detecting a change in load on the drum; a belt alignment sensor for detecting an alignment of the belt; a vibration sensor for detecting a vibration of the tower; and combinations thereof;

In one or more of the embodiments described herein, the unit further includes a gearbox, and the braking system includes a disk torsionally coupled to the gearbox; a piston disposed in a cylinder; a caliper connected to the piston; and a brake pad mounted to the caliper and movable by the piston between an engaged position and a disengaged position relative to the disk; and a bias member configured to bias the piston and the brake pad toward the engaged position.

In one or more of the embodiments described herein, the unit includes the speed sensor; and the detected speed of the belt is above a predetermined limit.

In one or more of the embodiments described herein, the speed sensor comprises a proximity sensor.

In one or more of the embodiments described herein, the unit includes the load sensor; and the detected change in load is above a predetermined limit.

In one or more of the embodiments described herein, the load sensor is disposed in a pillow block supporting the drum.

In one or more of the embodiments described herein, the unit includes the vibration sensor.

In one or more of the embodiments described herein, the unit includes a lubrication system for applying lubricant to at least one of a chain, a bearing, and combinations thereof.

In one or more of the embodiments described herein, the lubrication system includes at least one of a lubrication sensor for detecting an amount of lubricant in the lubrication system; a pressure sensor for detecting a pressure in the lubrication system; and a flow meter for measuring a flow rate of the lubricant.

In one or more of the embodiments described herein, the controller is in communication with the at least one of the lubrication sensor, the pressure sensor, and the flow meter, and operable to activate the brake system in response to detection of a faulty condition of the lubrication system.

In one or more of the embodiments described herein, the controller is configured to calculate an acceleration of the belt using the speed measured by the speed sensor.

In one or more of the embodiments described herein, the controller is operable to activate the brake system when the calculated acceleration is above a predetermined limit.

In one or more of the embodiments described herein, the unit includes a chain coupled to the prime mover and a carriage for coupling the chain to the counterweight.

In one or more of the embodiments described herein, the carriage is coupled to the counterweight using one or more slide bearings or one or more bushings.

In one or more of the embodiments described herein, the one of more slide bearings or the one or more bushings are coupled to one or more tracks on the counterweight.

In one or more of the embodiments described herein, the unit includes the cycle sensor; and the detected cycle was not completed within a predetermined time period.

In one or more of the embodiments described herein, the unit includes the alignment sensor; and the alignment sensor detected the presence of the belt.

While the foregoing is directed to embodiments of the present disclosure, other and further embodiments of the disclosure may be devised without departing from the basic scope thereof, and the scope of the invention is determined by the claims that follow.

The invention claimed is:

1. A reciprocating rod pumping unit, comprising:
- a tower;
- a counterweight assembly movable along the tower;
- a drum connected to an upper end of the tower and rotatable relative thereto;
- a belt having a first end connected to the counterweight assembly, extending over the drum, and having a second end connectable to a rod string;
- a prime mover for reciprocating the counterweight assembly along the tower;
- a sensor for detecting a condition of the pumping unit comprising:
  - a speed sensor for detecting a speed of the belt;
- a brake system for halting movement of the counterweight assembly; and
- a controller in communication with the speed sensor and operable to activate the brake system in response to the detected speed of the belt being above a predetermined limit.

2. The unit of claim 1, wherein:
- the unit further comprises a gearbox, and
- the braking system comprises:
  - a disk torsionally coupled to the gearbox;
  - a piston disposed in a cylinder;
  - a caliper connected to the piston; and
  - a brake pad mounted to the caliper and movable by the piston between an engaged position and a disengaged position relative to the disk; and
  - a bias member configured to bias the piston and the brake pad toward the engaged position.

3. The unit of claim 1, wherein the speed sensor comprises a proximity sensor.

4. The unit of claim 1, wherein:
- the unit further comprises a load sensor for detecting a change in load of the drum; and
- the controller is in communication with the load sensor and operable to activate the brake system in response to the detected change in load being above a predetermined limit.

5. The unit of claim 4, wherein the load sensor is disposed in a pillow block supporting the drum.

6. The unit of claim 1, further comprising a vibration sensor for detecting a vibration of the tower.

7. The unit of claim 1, further comprising a lubrication system for applying lubricant to at least one of a chain, a bearing, and combinations thereof.

8. The unit of claim 7, further comprising at least one of:
- a lubrication sensor for detecting an amount of lubricant in the lubrication system;
- a pressure sensor for detecting a pressure in the lubrication system; and
- a flow meter for measuring a flow rate of the lubricant.

9. The unit of claim 8, wherein the controller is in communication with the at least one of the lubrication sensor, the pressure sensor, and the flow meter, and operable to activate the brake system in response to detection of a faulty condition of the lubrication system.

10. The unit of claim 1, wherein the controller is configured to calculate an acceleration of the belt using the speed measured by the speed sensor.

11. The unit of claim 10, wherein the controller is operable to activate the brake system when the calculated acceleration is above a predetermined limit.

12. The unit of claim 1, further comprising a chain coupled to the prime mover and a carriage for coupling the chain to the counterweight.

13. The unit of claim 12, wherein the carriage includes a base coupled to the counterweight using one or more slide bearings or one or more bushings.

14. The unit of claim 13, wherein the one of more slide bearings or the one or more bushings are coupled to one or more tracks on the counterweight.

15. The unit of claim 1, further comprising a sensor for determining a cycle of the belt; and the controller is in communication with the sensor for determining the cycle and operable to activate the brake system in response to the detected cycle not completing within a predetermined time period.

16. The unit of claim 1, further comprising a belt alignment sensor for detecting an alignment of the belt; and the controller is in communication with the belt alignment sensor and operable to activate the brake system in response to the alignment sensor detecting the presence of the belt.

17. A reciprocating rod pumping unit, comprising:

a tower;

a counterweight assembly movable along the tower;

a drum connected to an upper end of the tower and rotatable relative thereto;

a belt having a first end connected to the counterweight assembly, extending over the drum, and having a second end connectable to a rod string;

a prime mover for reciprocating the counterweight assembly along the tower;

a sensor for detecting a condition of the pumping unit, wherein the sensor is a speed sensor for detecting a speed of the belt; and a controller in communication with the sensor and operable to cause the counterweight assembly to stop in response to the detected condition, wherein the controller is configured to calculate an acceleration of the belt using the speed measured by the speed sensor.

18. The unit of claim 17, wherein:

the unit further comprises a gearbox, and a braking system comprising:

a disk torsionally coupled to the gearbox;

a piston disposed in a cylinder;

a caliper connected to the piston; and a brake pad mounted to the caliper and movable by the piston between an engaged position and a disengaged position relative to the disk; and a bias member configured to bias the piston and the brake pad toward the engaged position.

19. The unit of claim 17, further comprising a lubrication system for applying lubricant to at least one of a chain, a bearing, and combinations thereof.

20. The unit of claim 19, further comprising at least one of:

a lubrication sensor for detecting an amount of lubricant in the lubrication system;

a pressure sensor for detecting a pressure in the lubrication system; and a flow meter for measuring a flow rate of the lubricant.

21. The unit of claim 17, further comprising a brake system for halting movement of the counterweight assembly, wherein the controller is operable to activate the brake system when the calculated acceleration is above a predetermined limit.

22. The reciprocating rod pumping unit of claim 17, further comprising:

a chain coupled to the prime mover; and a carriage for longitudinally coupling the chain to the counterweight assembly, the carriage includes a base that is movable transversely relative to the counterweight assembly.

23. The unit of claim 22, wherein the base is coupled to the counterweight using one or more slide bearings or one or more bushings.

24. The unit of claim 23, wherein the one of more slide bearings or the one or more bushings are coupled to one or more tracks on the counterweight.

25. A reciprocating rod pumping unit, comprising:

a tower;

a counterweight assembly movable along the tower;

a drum connected to an upper end of the tower and rotatable relative thereto;

a belt having a first end connected to the counterweight assembly, extending over the drum, and having a second end connectable to a rod string;

a prime mover for reciprocating the counterweight assembly along the tower;

a brake system for halting movement of the counterweight assembly;

a lubrication system for applying lubricant to at least one of a chain, a bearing, and combinations thereof;

at least one of:

a lubrication sensor for detecting an amount of lubricant in the lubrication system;

a pressure sensor for detecting a pressure in the lubrication system; and a flow meter for measuring a flow rate of the lubricant; and a controller in communication with the at least one of the lubrication sensor, the pressure sensor, and the flow meter, and operable to activate the brake system in response to detection of a faulty condition of the lubrication system.

26. A reciprocating rod pumping unit, comprising:

a tower;

a counterweight assembly movable along the tower;

a drum connected to an upper end of the tower and rotatable relative thereto;

a belt having a first end connected to the counterweight assembly, extending over the drum, and having a second end connectable to a rod string;

a prime mover for reciprocating the counterweight assembly along the tower;

a sensor for detecting a condition of the pumping unit selected from the group consisting of:

a speed sensor for detecting a speed of the belt;

a cycle sensor for detecting a cycle of the belt;

a load sensor for detecting a change in load on the drum;

a belt alignment sensor for detecting an alignment of the belt;

a vibration sensor for detecting a vibration of the tower; and combinations thereof;

a gearbox;

a brake system for halting movement of the counterweight assembly, the brake system having:

a disk torsionally coupled to the gearbox;

a piston disposed in a cylinder;

a caliper connected to the piston; and a brake pad mounted to the caliper and movable by the piston between an engaged position and a disengaged position relative to the disk; and a bias member configured to bias the piston and the brake pad toward the engaged position; and a controller in communication with the sensor and operable to activate the brake system in response to detection of the faulty condition of the pumping unit.

* * * * *